US005332105A

United States Patent [19]

Stanfield

[11] Patent Number: 5,332,105

[45] Date of Patent: Jul. 26, 1994

[54] PORTABLE DISH RACK

[76] Inventor: John Stanfield, 425 Riverhill Dr., Atlanta, Ga. 30328

[21] Appl. No.: 959,792

[22] Filed: Oct. 13, 1992

[51] Int. Cl.[5] ..... A47F 5/00

[52] U.S. Cl. ..... 211/41; 211/4

[58] Field of Search ..... 211/41, 4, 84, 195

[56] References Cited

U.S. PATENT DOCUMENTS

| | | | |
|---|---|---|---|
| 1,595,421 | 8/1926 | Rose . | |
| 3,303,934 | 2/1967 | Pressley, Jr. | 211/41 |
| 4,733,781 | 3/1988 | Gerlach | 211/41 |
| 4,917,248 | 4/1990 | Friskney | 211/41 |
| 4,969,560 | 11/1990 | Stanfield | 211/41 |
| 5,205,419 | 4/1993 | Purtilo | 211/41 |

*Primary Examiner*—Alvin C. Chin-Shue
*Assistant Examiner*—Sarah A. Lechok
*Attorney, Agent, or Firm*—Kennedy & Kennedy

[57] ABSTRACT

A dish rack (10) has a wire mesh frame (11) that defines a space in which a set of dishes may be supported uprightly. A central dish support (45) and two outer dish supports (43), each having a series of notches (48), are mounted to the frame. An upper dish support (70) having a series of notches (72) is pivotably mounted to the frame for engagement with the top, periphery of a plate supported upon the lower dish supports.

5 Claims, 3 Drawing Sheets

PORTABLE DISH RACK

TECHNICAL FIELD

This invention relates generally to dish racks, and particularly to dish racks for use in carrying and supporting dishes in dishwashers.

BACKGROUND OF THE INVENTION

In the restaurant, tableware rental, and food catering industries large numbers of dishes must be racked, washed and stacked. The sheer volume of such activity demands that dish racks be designed for ease and speed of loading and unloading. At the same time, they must be constructed so that likelihood of breakage is minimized during loading, unloading and transport. Where the racks are incorporated into or used in dishwashers, they must also be designed so that water sprays effectively clean the dishes and provide good drainage.

An early dish rack specifically designed for use in a dishwasher is shown in U.S. Pat. No. 1,595,421. The dish rack here has a frame that supports a set of mutually spaced, parallel rods between which dishes are placed uprightly. Handles are provided for use in placing the rack, loaded with dishes, into and out of a dish washing machine. This type of rack, specifically designed for use in dishwashers, has several deficiencies. Probably foremost amongst these is its inability to hold different size dishes in a secure manner. The support rods are simply placed apart a distance sufficient to accommodate a selected maximum sized dish in order that it may be used to hold that size dish and smaller dishes. This results in good support for the larger size dishes but only loose support for the smaller dishes. It also sacrifices economy of space for the smaller dishes.

Another dish rack design is shown in U.S. Pat. No. 3,303,934 which is permanently mounted in a dishwasher. It has several sawtooth shaped support rods, selected grouping of which are used to support different sized dishes. Depending on their size, dishes are supported on as few as two or as many as six rods. This design scheme is to provide a sufficiently large number of supports so that several combinations are available to hold dishes of various sizes in a reasonably secure and separated manner. Inherently such designs suffer from excess structure and problems typically associated with compromised designs. Being built-in rather than portable, this type of rack, as with the previously described racks, also requires that dishes be removed and either reracked or restacked outside of the dish washer for storage or transportation. A more recent rack design is shown in U.S. Pat. No. 4,969,560. The dish rack here has three sawtooth shaped support members which hold plates about their periphery. Although this design works reasonably well in enabling dishes to be washed and transported, many problems still exist. For example, should the rack be abruptly rocked or tilted during transportation the dishes therein may ride over the upper supports thereby becoming dislodged from the rack. Also, when not in use these types of racks occupy a large amount of space, making their transportation and storage inefficient.

Accordingly, it is seen that a need still remains for a portable dish rack for use in dishwashers that can effectively and securely hold dishes of various sizes with minimal risk of breakage, which are readily placeable and removable from dishwashers, and which are efficiently stored when not in use. It is to the provision of such that the present invention is primarily directed.

SUMMARY OF THE INVENTION

In a preferred form of the invention, a portable dish rack comprises a frame defining a space in which a set of dishes may be supported uprightly. The frame has an open top through which dishes may be inserted and withdrawn, three generally parallel lower dish supports mounted to the frame and having a series of notches, and an upper dish support movably mounted to the frame for movement between a position engaging dishes supported upon the lower dish supports and a position withdrawn from the dishes and unobstructing their removal from the frame space. With this construction the peripheries of dishes may be supported upon the lower dish supports and maintained in position by engagement of the upper dish support with the peripheries of the dishes.

DETAILED DESCRIPTION

Figure 1:
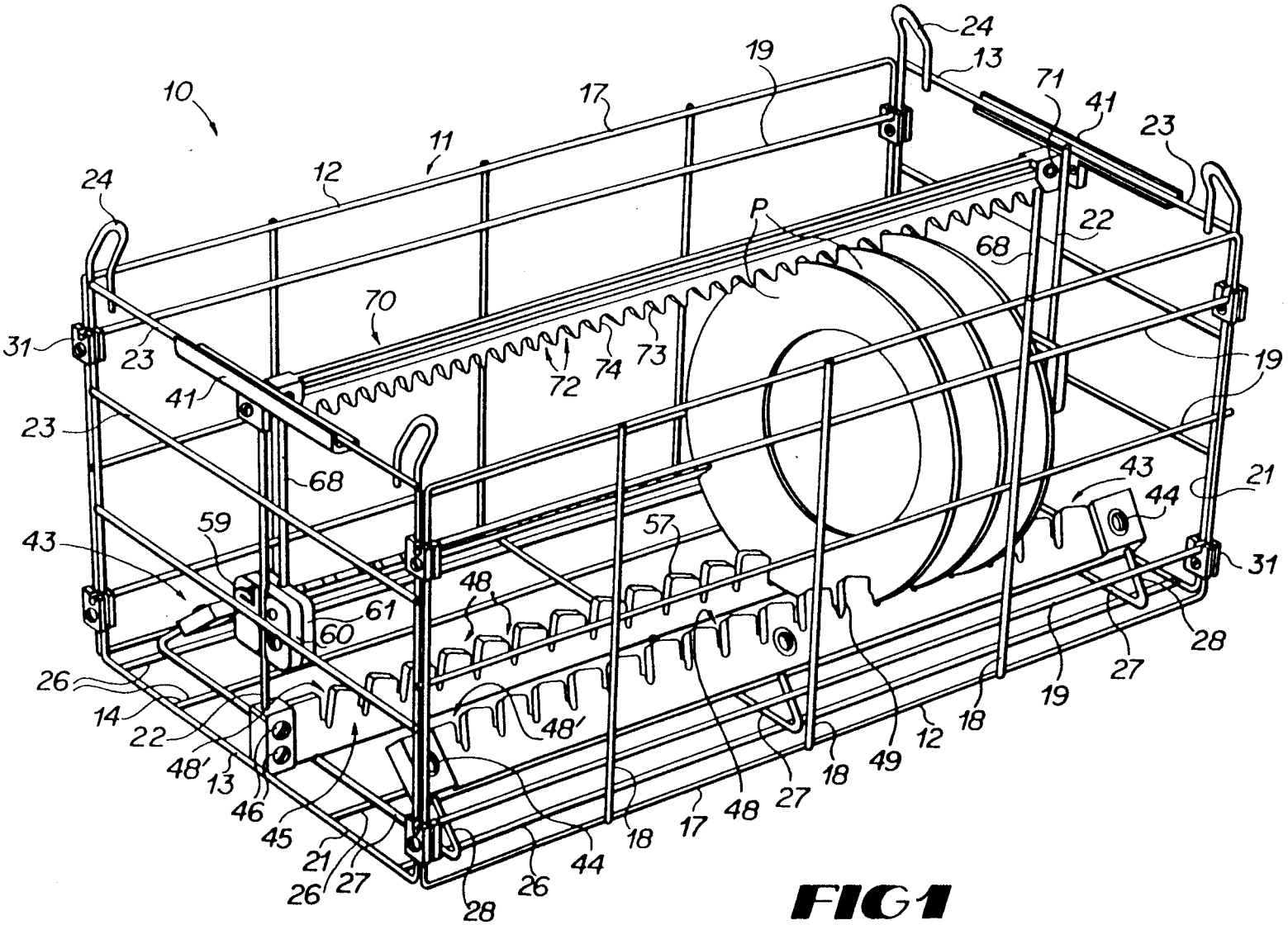
FIG. 1 is a perspective view of a dish rack embodying principles of the invention in a preferred form, shown with three dishes mounted therein.

With reference next to the drawing, there is shown in FIG. 1 a dish rack 10 having a wire mesh frame 11 that defines a space in which a set of dishes may be supported uprightly. The frame 11 has two parallel wire mesh side walls 12, two parallel wire mesh end walls 13, and a wire mesh bottom wall 14. The side walls 12 have a rectangular peripheral wire 17 to which a set of three upright wires 18 and a set of three cross wires 19 are bonded. The end walls 13 have a generally U-shaped wire 21 to which an upright wire 22 and a set of three cross wires 23 are bonded. The upper portions of the U-shaped wire 21 are enturned to form bights 24 which are bent inwardly from the uppermost cross wire 23. The bottom wall 14 has a set of five longitudinal wires 26, the unshown middle longitudinal wire of which has upturned ends, bonded to a set of three lateral wires 27 having upwardly and inwardly bent end portions 28.

Figure 4:
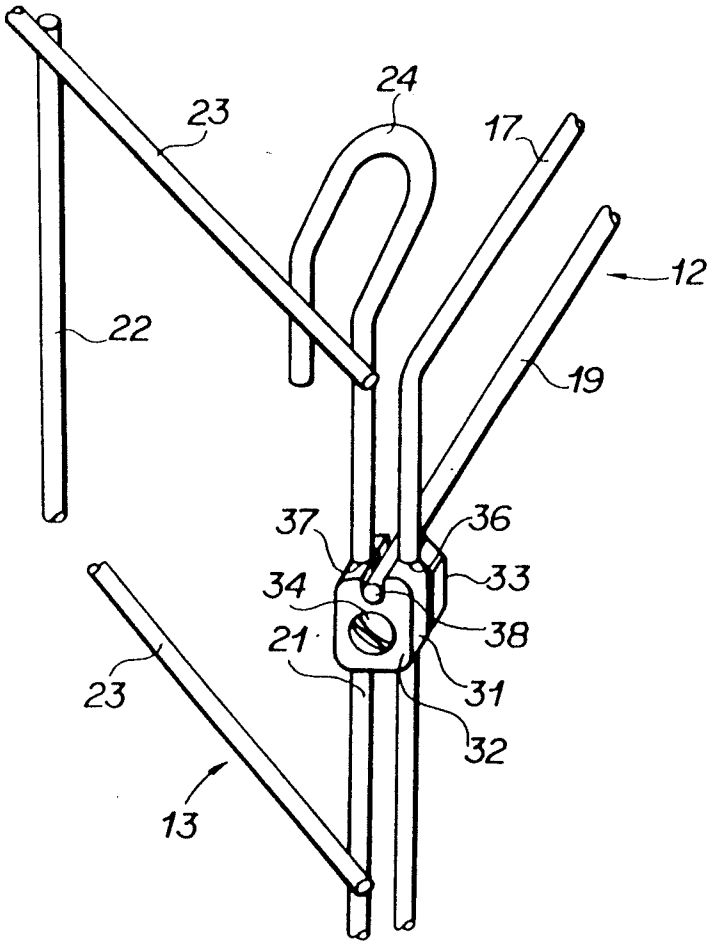
FIG. 4 is a perspective view of a corner portion of the dish rack of FIG. 1.

Corner brackets 31 join the side walls 12 to the end walls 13, as best shown in FIG. 4. Each corner bracket 31 has an outer portion 32 with a hole therethrough, an inner portion 33 with a threaded hole, and a mounting bolt 34 which passes through the outer portion hole and is threadably mounted in the inner portion hole. The corner bracket 31 also has a vertical channel 36 therethrough sized and shaped to receive a peripheral wire 17, a vertical channel 37 therethrough sized and shaped to receive an U-shaped wire 21, and a horizontal channel 38 therethrough sized and shaped to receive a side wall cross wire 19. Low heat transfer handles 41, preferably formed of plastic material, are fixedly mounted to the uppermost end wall cross wire 23.

The dish rack 10 further has two lower, outer dish supports 43 adjustably mounted to the end portions 28 of the bottom wall lateral wires 27 by bolts 44, and a lower, central dish support 45 fixedly mounted to the upturned ends of the bottom wall middle longitudinal wire 26 and the end wall central upright wire 22 by bolts 46.

Figure 5:
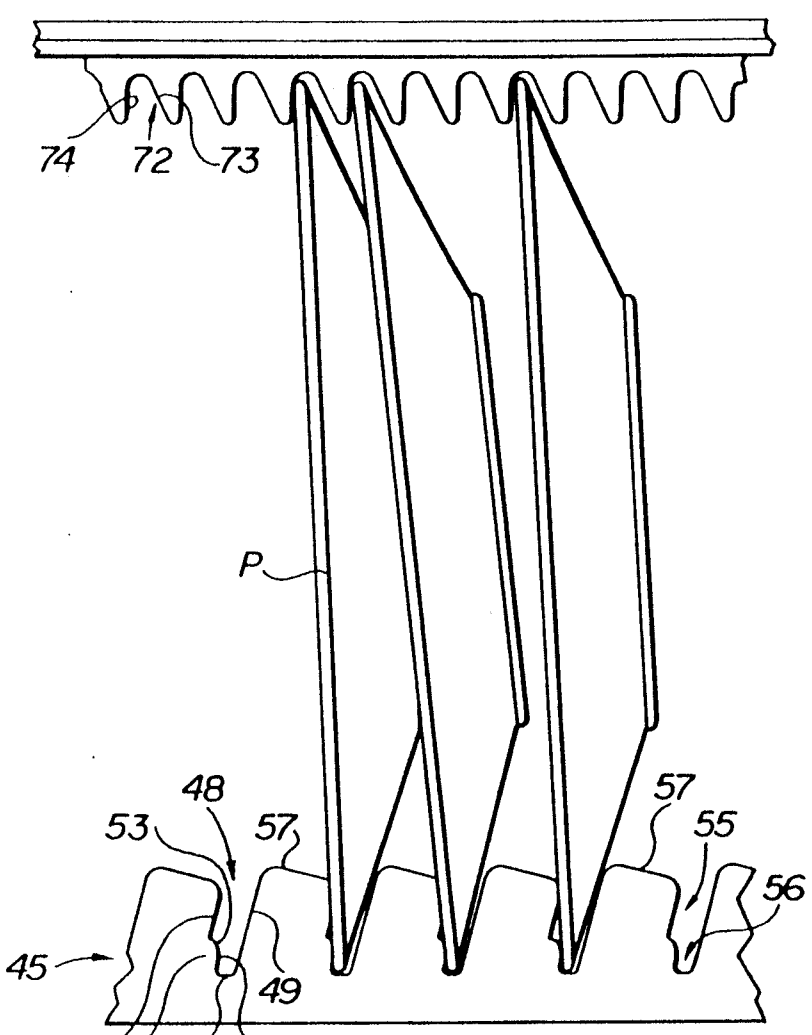
FIG. 5 is a side elevational view of a portion of the upper and of one lower dish support of the dish rack of FIG. 1.

As best shown in FIG. 5, the lower dish supports 45, as well as lower dish supports 43, have a series of notches 48, each of which has a front wall 49, rear wall 50, a floor 51 and a step 52 extending between the front wall 49 and the floor 51. The step 52 has a top wall 53 and a side wall 54. The front wall 49 and the rear wall 50 form a channel 55 therebetween, while the front wall 49 and the step side wall 54 form a channel 56 therebetween extending from channel 55. An inclined bearing wall 57 extends adjacent both sides of each notch 48.

A pivot latch 59 is mounted to each end wall 13 of frame 11. The pivot latch 59 is comprised of a mounting portion 60 which is fixedly mounted to the end wall and a pivot portion 61 which pivots relative to the mounting portion 60. The mounting portion 60 has a vertical channel which receives the end wall upright wire 22, a horizontal channel which receives the bottommost end wall cross wire 23, and a mounting bolt 63 which fixedly mounts each pivot latch to the end walls. The mounting portion 60 also has a resilient tongue 65 which may be biased downward towards the bottom wall 14, and a side wall 66 adjacent the tongue 65. The pivot portion 61 has a post 67. Elongated arms 68 are adjustably mounted at one end to the pivot portion 61 of each pivot latch 59. An upper dish support 70 is adjustably mounted at each of its ends to the ends of the elongated arms 68 opposite pivot latch 59 by a bolt 71. The upper dish support 70 has a series of notches 72. Each notch 72 has a bearing wall 73 and a plate support wall 74.

Figure 2:
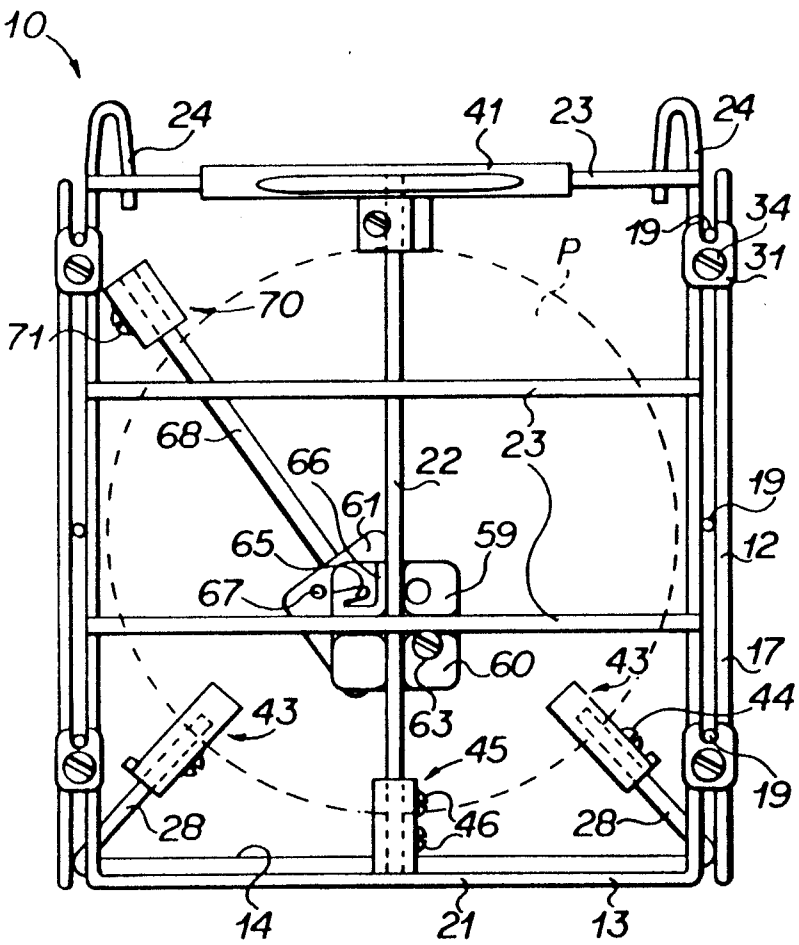
FIG. 2 is a side elevational view of the dish rack of FIG. 1 shown with an upper dish support in an withdrawn position.

The outer dish supports 43 are adjusted upon the end portions 28 of the lateral wires 27 so that the periphery of a plate of the size to be washed may be supported by the outer dish supports 43 and the central dish support 45. The positions of the outer dish supports are established by sliding them upwardly along the end portions 28 until they contact the periphery of a plate supported upon the central dish support 45. The outer dish supports are then fixed in place by tightening bolts 44 which draws the outer dish support tightly to the end portion 28. The upper dish support 70 is then pivoted upwards and adjusted upon each arm 68 so that the periphery of the plate is seated firmly within notch 72. The position of the upper dish support is established by sliding it downwardly along arm 68 until it contacts the periphery of the plate. The upper dish support is then fixed in place by tightening bolts 71 which draws the upper dish support tightly to the arms 68. In use, to allow unobstructed access through the top of the frame 11 to the lower dish supports 43 and 45 the upper dish support is pivoted towards the side wall 12 of the frame 11, as shown in FIG. 2. The rack may then be loaded plate by plate. An initial plate to be washed is placed in the rack 10 by passing it through the open top of the frame, positioning it in the first notches 48' of the outer dish supports 43 and the central dish support 45, and lowering it until it is snugly held within channel 55 or 56, depending upon on the width or thickness of the plate. A thick plate seats within channel 55 with its periphery resting upon the top wall 53 of step 52 while a thinner plate extends into and seats within channel 56 with its periphery resting upon floor 51. With this construction both thick and thin plates are snugly held within the channels of the notches by their corresponding side walls.

Additional plates P are loaded by using the underside of a previously loaded plate as a guiding surface until the plate contacts the inclined bearing wall 57 of the dish supports 43 and 45. The plate then slides down bearing wall 57 into the adjacent notch 48 where it becomes seated. Plates P may be continuously loaded in this manner until all notches 48 are occupied or there are no plates remaining to be loaded.

Figure 3:
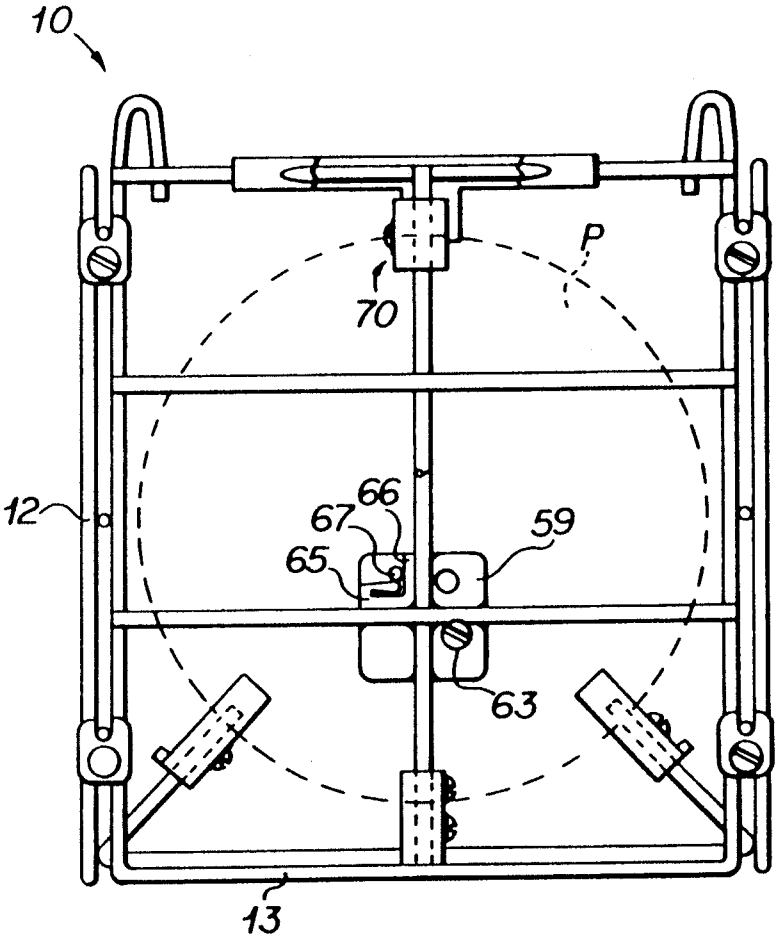
FIG. 3 is a side elevational view of the dish rack of FIG. 1 shown with an upper dish support in a dish engaged position.

The upper dish support 70 is finally pivotably about pivot latch 59 into engagement with the top, periphery of the plates P, as shown in FIG. 3. It should be noted that there are approximately twice as many upper dish support notches 72 as lower dish support notches 48 so that plates need not be perfectly aligned in order to be held within the rack 10, as shown in FIG. 5. To maintain the position of the upper dish support, the post 67 of the pivot portion 61 bears on the tongue 65 of the mounting portion 60, thereby forcing the tongue downward until the post nests between the tongue and the side wall 66 of the mounting portion 60. With the upper dish support in this position the rack may be placed in a dishwasher or transported at any angle, even inverted, without the plates becoming loose within the rack.

It should also be noted that the frame 11 may be collapsed to conserve space during storage and transportation. To do so the bottom wall 14 is removed by loosening bolts 46 so as to dismount the central dish support 45 from the central upright wire 22 of the end walls 13. The pivot latches 59, adjoining arms 68, and adjoining upper dish support 70 are also removed from the frame 11 by loosening pivot latch mounting bolts 63. Finally, each corner bracket bolt 34 is loosened to allow U-shaped wire 21 to rotate within vertical channel 37 so that the end walls may pivot about the corner brackets, as shown in FIG. 4. The end walls are rotated in this manner to a collapsed frame configuration with an end wall and a side wall overlaying the opposite end wall and side wall.

Racks of the type just described may also be stacked one upon another to facilitate storage and economy of space in transporting sets of dishes. In this regard the bights 24 of the U-shaped wire 21 are used as guides when stacking racks.

From the foregoing it can be seen that a dish rack is now provided which overcomes problems long associated with those of the prior art. It should, however, be understood that the just described embodiment merely illustrates principles of the invention in a preferred form. Many modifications, additions and deletions may, of course, be made thereto without departure from the spirit and scope of the invention set forth in the following claims.

What is claimed is:

1. A portable dish rack comprising a frame defining a space in which a set of dishes may be supported uprightly, said frame having an open top through which dishes may be inserted and withdrawn, a plurality of generally parallel lower dish supports mounted to said frame and having a series of notches each having a first portion sized to receive and hold dishes of a selected thickness and a second portion sized to receive and hold dishes of a thickness greater than said selected thickness, and an upper dish support movably mounted to said frame for movement between a position engaging dishes supported upon said lower dish supports and a position withdrawn from the dishes and unobstructing their removal from said frame space, whereby the peripheries of dishes may be supported upon the lower dish support and maintained in position by engagement of the upper dish support with the peripheries of dishes.

2. A portable dish rack comprising a frame defining a space in which a set of dishes may be supported uprightly, said frame having an open top through which dishes may be inserted and withdrawn, a plurality of generally parallel lower dish supports mounted to said frame and having a series of notches, and an upper dish support having a series of notches, and wherein said upper dish support has a selected number of said notches per a selected length and said lower dish supports have a selected number of said notches per said selected length, and wherein said number of upper dish support notches is substantially greater than said number of lower dish support notches, said upper dish support being movably mounted to said frame for movement between a position engaging dishes supported upon said lower dish supports and a position withdrawn from the dishes and unobstructing their removal from said frame space, whereby the peripheries of dishes may be supported upon the lower dish supports and maintained in position by engagement of the upper dish support with the peripheries of dishes.

3. A portable dish rack comprising a collapsible frame defining a space in which a set of dishes may be supported uprightly, said frame having an open top through which dishes may be inserted and withdrawn, a plurality of generally parallel lower dish supports mounted to said frame and having a series of notches, and an upper dish support movably mounted to said frame for movement between a position engaging dishes supported upon said lower dish supports and a position withdrawn from the dishes and unobstructing their removal from said frame space, whereby the peripheries of dishes ay be supported upon the lower dish supports and maintained in position by engagement of the upper dish support with the peripheries of dishes.

4. A dish rack comprising a generally rectangular, open top wire mesh frame; a plurality of lower dish supports mounted to said frame; and an upper dish support movably mounted to said frame for movement between a position engaging dishes supported upon said lower dish supports and a position withdrawn from the dishes and unobstructing their removal through said frame open top, and wherein said upper dish support is formed with a series of notches and wherein each of said lower dish supports is formed with a series of notches having a first side wall, a second side wall oriented generally parallel to said first side wall to form a first channel therebetween sized to receive and hold a dish of a selected width, a step extending from said second side wall having a side wall oriented generally parallel to said first side wall to form a second channel therebetween sized to receive and hold a dish of a width less than said selected width, said upper dish support has a selected number of said notches per a selected length and said lower dish supports have a selected number of said notches per said selected length, and wherein said number of upper dish support notches is substantially greater than said number of lower dish support notches, whereby dishes of different widths are each snugly held within the lower dish support notches.

5. A dish rack comprising a generally rectangular, collapsible, open top wire mesh frame; a plurality of lower dish supports mounted to said frame; and an upper dish support mounted to said frame for movement between a position engaging dishes supported upon said lower dish supports and a position withdrawn from the dishes and unobstructing their removal through said frame open top, and wherein each of said lower dish supports is formed with a series of notches having a first side wall, a second side wall oriented generally parallel to said first side wall to form a first channel therebetween sized to receive and hold a dish of a selected width, a step extending from said second side wall having a side wall oriented generally parallel to said first side wall to form a second channel therebetween sized to receive and hold a dish of a width less than said selected width, whereby dishes of different widths are each snugly held within the lower dish support notches.

* * * * *